United States Patent [19]

Williams

[11] 4,278,041

[45] Jul. 14, 1981

[54] ANCHOR HANDLING GUIDES

[75] Inventor: Billy W. Williams, Morgan City, La.

[73] Assignee: McDermott Incorporated, New Orleans, La.

[21] Appl. No.: 92,014

[22] Filed: Nov. 7, 1979

[51] Int. Cl.[3] ..... B63B 21/04; B63B 21/22; B66D 1/38

[52] U.S. Cl. ..... 114/210; 114/218; 254/395; 254/398

[58] Field of Search ..... 114/210, 218; 254/393–396, 398, 402

[56] References Cited

U.S. PATENT DOCUMENTS

| | | | |
|---|---|---|---|
| 1,299,529 | 4/1919 | Young | 114/218 |
| 2,783,025 | 2/1957 | Scheidt | 254/396 |
| 3,588,051 | 6/1971 | Leeming | 254/395 |

*Primary Examiner*—F. J. Bartuska

*Attorney, Agent, or Firm*—Robert J. Edwards; Stephen R. Doody; John L. LaPierre

[57] ABSTRACT

A pair of pin assemblies located at the stern of a marine vessel for guiding and controlling cables involved in anchor handling procedures, the pins assuming a vertical position when in use and a horizontal position when not in use, the top of the pin assemblies being flush with the vessel's deck when the pins are not in use.

5 Claims, 5 Drawing Figures

ANCHOR HANDLING GUIDES

TECHNICAL FIELD

This invention relates to devices used on marine vessels for guiding and controlling cables and, more particularly, to a pair of pin assemblies located at the vessel's stern for use in anchor handling procedures.

BACKGROUND ART

Marine vessels perform a variety of tasks, one of which is the handling of anchors. This is particularly important in the offshore oil and gas industry where very large drilling rigs are kept in position by a plurality of anchors. Because of their size and the nature of the anchoring procedures, these drilling rigs require assistance from other vessels in anchor handling procedures.

The term "anchor handling" describes a wide variety of operations including the following: receiving the anchor from the rig, carrying the anchor to its proper location and deploying it, extracting the anchor from the sea bottom and hauling it to the surface, bringing the anchor on board the retrieving vessel, and carrying the anchor back to the rig. Some anchor handling procedures involve all of the above, while other procedures involve only some of the above.

There are basically two types of marine vessels which assist the rig in anchor handling, the tub and the supply-tug. The latter resembles the traditional tug except that it has an extended rear deck section.

This extra deck space makes the supply-tug more suitable than the tug for those anchor handling operations involving the boarding of anchors. When an anchor is brought on board, even in moderately calm seas, the anchor is jostled about the deck. The supply-tug deck provides ample room for the anchor to move about without becoming entangled with the men and equipment located at the forward deck of the vessel. Additionally, the extra deck space on the supply-tug provides necessary storage for the anchor as well as other items associated with anchors such as anchor buoys and cables.

The usual method of extracting a drilling rig anchor from the sea floor involves the use of a cable called a pennant line. One end of the pennant line is attached to the anchor. The other end is attached to the anchor's marker buoy.

When the anchor is in place in the sea floor, the pennant line is slack, the buoy being allowed to float relatively free. When the anchor is to be extracted from the sea floor, the retrieving vessel locates the buoy and brings it on board. The pennant line which was attached to the buoy is then attached to a winch located approximately in the center of the vessel and the slack is taken out of the line. The next step involved in extracting the anchor is known as "breaking anchor".

In this step, a tremendous pulling force is gradually applied to the anchor via the pennant line until the anchor is freed from the seabed. Because of the tremendous tension in the pennant line while breaking anchor, it is important to keep the pennant line centered at the vessel's stern. Centered thusly, the vessel's engines are used more efficiently and there is less danger of the vessel capsizing. After breaking anchor and while hauling the anchor to the surface, it is desirable to maintain the pennant line centered at the vessel's stern instead of allowing the line to rub back and forth across the stern.

The traditional way of centering the pennant line has been to use a pair of vertical pins located at the center of the vessel's stern in combination with a winch situated at the vessel's center, forward of the stern.

Vertical pins are employed on both tugs and supply-tugs while breaking and hauling in the anchor. Because the supply-tug is used for jobs not normally performed by the tug, particularly the boarding of anchors, there has been a divergence in the development of vertical pins used on tugs as compared with those vertical pins used on supply-tugs. Due to the weight of the anchor and in order to avoid interference with the anchor, the vertical pins used on a supply-tug must be capable of "disappearing" i.e. there must be no manifestation of their presence on deck immediately prior to bringing the anchor on board.

Vertical pins generally used today on a supply-tug are best described as dowels which fit into cylindrical cavities located at the stern beneath the deck. Many such vertical pins are manually inserted and manually removed from the cavity. Some supply-tugs are equipped with hydraulically operated pins which are normally stored inside their cylindrical cavity, the top of the pin being flush with the deck. The pins are hydraulically raised and lowered as needed.

There have been problems associated with the dowel-cylindrical cavity type of vertical pin used on supply-tugs. Often, when such pins are in their raised position, the pennant line is pulled very strongly against one of the pins. When subjected to such a horizontal load the pin, being supported at only one end, often becomes bent. Such bending causes the dowel to become stuck in its cavity. So stuck, the pin is a very aggravating and dangerous nuisance because the anchor must either be pulled over the obstructing pin or the anchor boarding procedure must be delayed until the deformed pin is cut off. Also, because this type of vertical pin requires a very close fit between the dowel and the cavity, rust and debris have been known to cause the dowel to stick in its cavity.

These problems have generally not been encountered with the vertical pins used on tugs. Because a tug normally doesn't board anchors, there is no need to have pins which are capable of "disappearing" from the deck. This means the vertical pin can be sufficiently strengthened against deformation by various frames and supporting devices securely fixed to the deck.

SUMMARY OF THE INVENTION

The disclosed invention overcomes the problem of deformed vertical pins on supply-tugs by providing a frame which gives support and hence added strength to the pin, yet the frame and pin are capable of "disappearing" from the deck at the appropriate times. The frame, supporting the pin at both ends, is attached to a horizontally disposed rotatable drum. By rotating the drum, the pin can be moved back and forth from a vertical to a horizontal position. In the horizontal position, the pin, frame and drum are located beneath the deck. A cover plate attached to the frame and drum forms part of the deck when the pin is in the horizontal position, thereby eliminating the pins as a source of obstruction and entanglement when boarding the anchor.

BEST MODE FOR CARRYING OUT THE INVENTION

Figure 1:
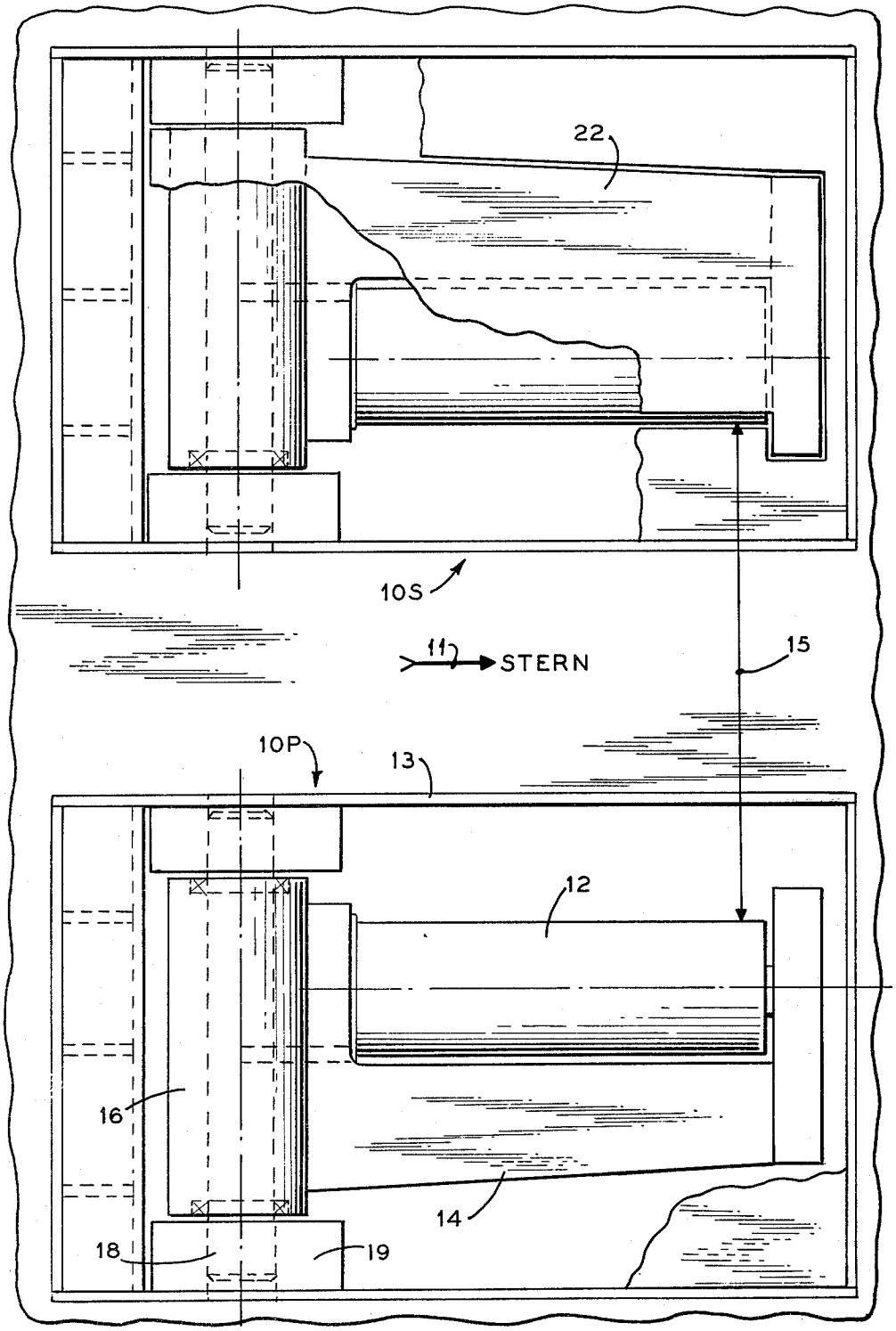
FIG. 1 is a plan view, partly broken away, of a pair of pin assemblies, the pins being in the horizontal position.

FIG. 1 illustrates a pair of pin assemblies, 10*p* being the port side pin assembly and 10*s* being the starboard side pin assembly. Arrow 11 indicates the direction of the stern of the vessel. Pin assemblies 10*p* and 10*s* are mirror images of each other, the component parts of each being identical.

Figure 2:
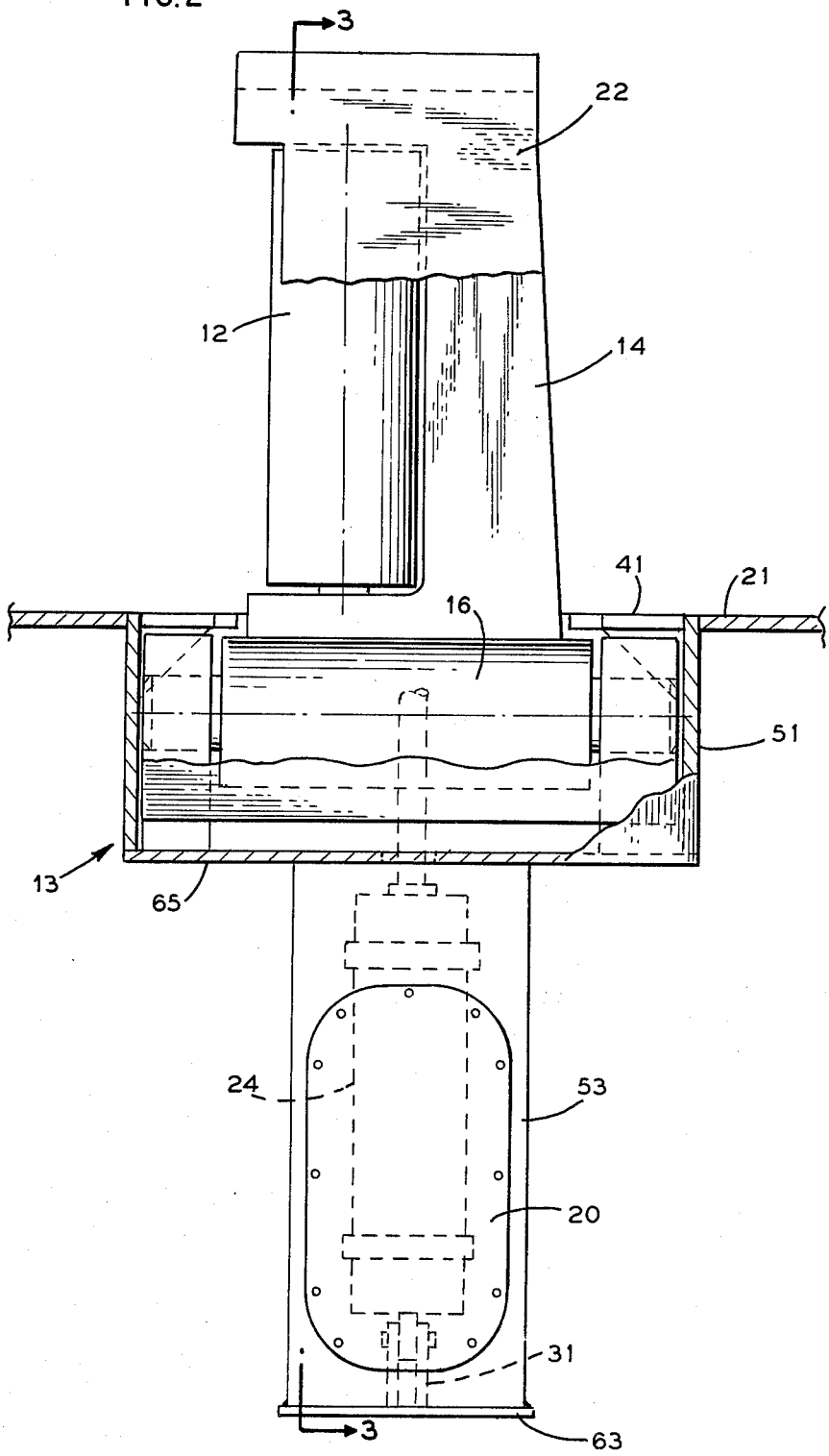
FIG. 2 is elevation view, partly broken away, of the port side pin assembly looking aft.

Using assembly 10*p* in FIG. 1 to illustrate the component parts of a typical pin assembly, said assembly is encased in housing 13. Pin 12 is rotatably mounted in frame 14. In FIG. 1, the pin is shown in its horizontal position. In FIG. 2, the pin is shown in its vertical position. Frame 14 provides support for pin 12 at both ends of the pin.

Frame 14 is connected to drum 16, the connection preferably being made by welding. Drum 16 rotates about its journal 18. Journal Box 19 transmits the load of the drum and attached components to housing 13.

Assembly 10*s* in FIG. 1 shows cover plate 22 in position.

FIG. 1 shows that pin assemblies 10*p* and 10*s* are spaced apart, the distance 15 between the inside surfaces of the pins being approximately 20 inches in the preferred embodiment of the invention. The distance 15 must be large enough to accommodate the passage therethrough of the pennant line as well as large cable connectors and the like.

Figure 3:
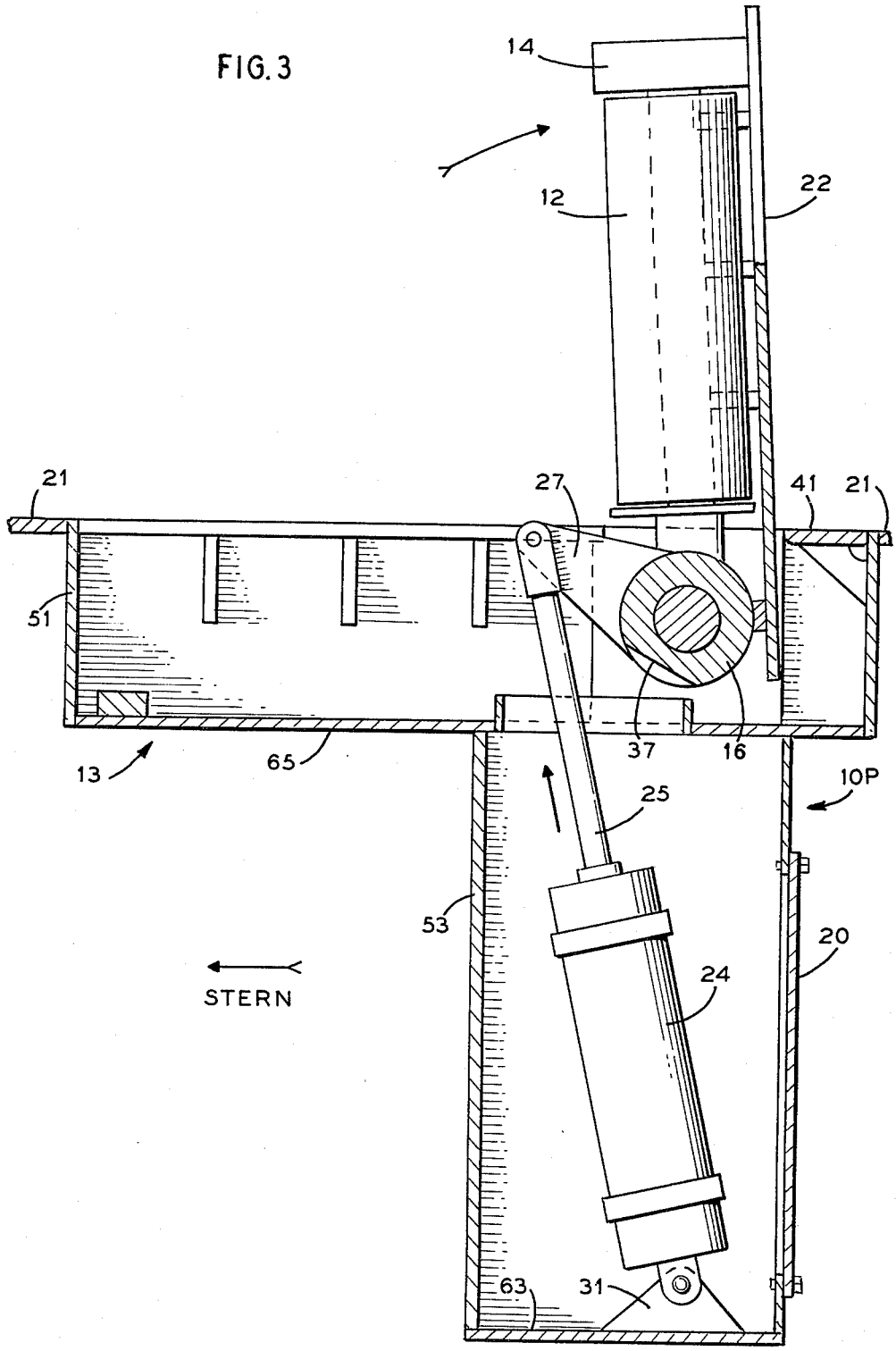
FIG. 3 is a sectional view taken along line 3—3 in FIG. 2.

Drum rotation and hence movement of the pin from a horizontal to a vertical position is preferably provided by piston and cylinder arrangement 24, shown in FIGS. 2 and 3. Arrangement 24 is pivotally connected to the base mounting 31. The piston rod 25 of arrangement 24 is pivotally connected to drum 16, the connection in the preferred embodiment being made via drum extension 27. Arrangement 24 is preferably operated pneumatically, thereby making use of the readily available pneumatic system which exists on most vessels. As the piston rod 25 extends causing drum 16 to rotate, the attached pin 12 is moved from a horizontal to a vertical position. Manhole cover 20 facilitates access to arrangement 24 for repairs.

Use of piston and cylinder arrangement 24 to maintain this vertical position, especially when a pennant line or the like is pushing against the pin, would unduly strain the pressure system operating the arrangement. Therefore, a load bearing member is used to maintain the vertical position of the pin. In the preferred embodiment, such load bearing member is in the form of slideable wedge 33 shown in FIG. 5. (For the sake of clarity, wedge 33 is not shown in FIGS. 3 and 4.)

When drum 16 is rotated so as to lift pin 12 to its vertical position, the flat surface 37 of drum 16 is moved to a position adjacent and parallel to flat surface 35 of wedge 33. Wedge 33 is then moved to its extended position, surface 35 engaging surface 37. Arrangement 24 may now be relaxed, wedge 33 preventing drum rotation, thereby maintaining the pin in the vertical position. To lower the pin to a horizontal position, the procedure is reversed. Arrangement 24 is activated, taking the pressure off wedge 33. Wedge 33 is then withdrawn to its retracted position which allows the drum to rotate, thereby moving the pin to its horizontal position. Piston and cylinder arrangement 30 is the driving force behind wedge 33. It is preferably operated pneumatically, drawing from the same source as arrangement 24.

In the preferred embodiment, the vertical position of pin 12 is just slightly less than truly vertical. Such design urges the pin to fall to its horizontal position, thereby removing the possibility that the pin will remain balanced in the vertical position after wedge 33 is removed.

A device (not shown) already known in the art is used to coordinate the timing of the activation of arrangement 24 relative to arrangement 30. Said device is also used to coordinate the activation of one pin assembly relative to the other pin assembly.

Figure 4:
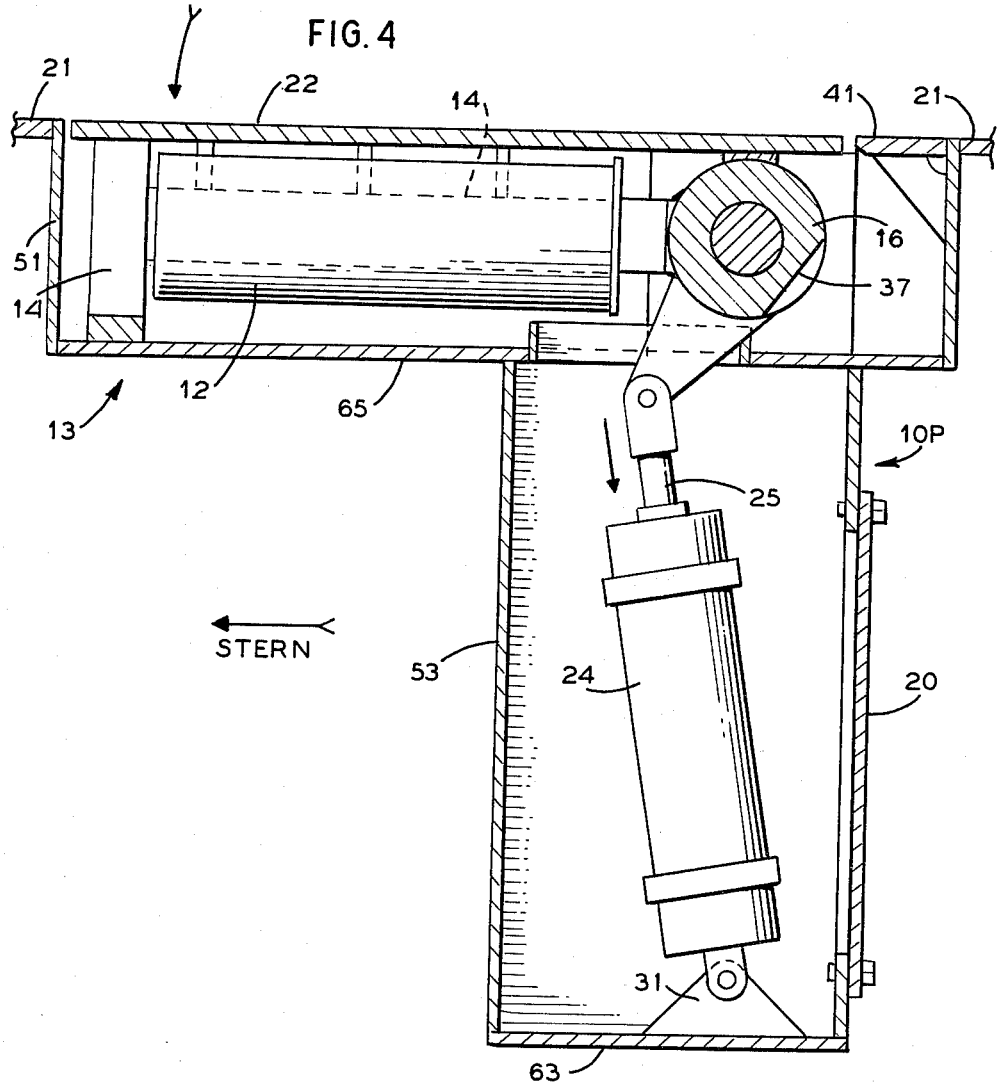
FIG. 4 is a view taken along the same line as FIG. 3, FIG. 4 showing the pin in the horizontal position.
Figure 5:
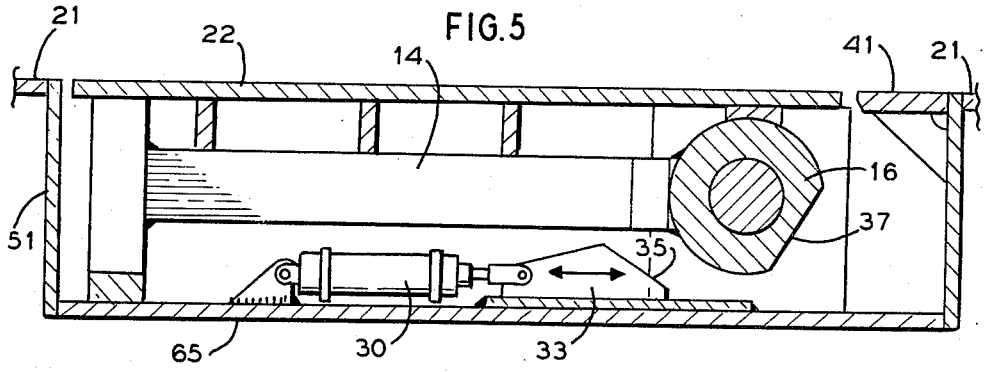
FIG. 5 is an elevation view, partly in section, of the upper portion of the pin assembly housing.

As shown in FIGS. 3, 4 and 5, cover plate 22 is attached to frame 14 and drum 16. The plate 22, pin 12, and frame 14 move as one unit as drum 16 is rotated. When pin 12 is in the horizontal position, cover plate 22 is flush with the deck 21.

As shown in FIGS. 2, 3 and 4, the housing 13 is recessed below the deck 21 so that the housing top 41 is flush with the deck 21. Therefore, when the pin is in its horizontal position, the entire pin assembly is below deck except the cover plate 22 and housing top 41 which form a part of the deck.

FIGS. 2 and 3 depict the preferred configuration of housing 13. The housing 13 has an upper portion 51 which has the shape of a rectangular box whose base is several times that of its height. Upper portion 51 houses the pin 12, frame 14, drum 16, arrangement 30 and wedge 33 (arrangement 30 and wedge 33 are shown in FIG. 5.)

Housing 13 also has a lower portion 53 which has the shape of a rectangular box whose height is several times that of its base. The lower portion 53 serves mainly to house arrangement 24 and support upper portion 51.

The preferred configuration makes the housing readily adaptable to most vessels. The lower portion 53 fits into the stern of the vessel, which in most vessels is an area that is usually hollow space, void of rudder mechanisms. The upper portion 51 is located directly above rudder mechanisms and the like on most vessels, but because upper portion 51 is relatively shallow, it does not interfere with these mechanisms. The base plate 65 of upper portion 51 and the base plate 63 of lower portion 53 are attached to and supported by structural members (not shown) of the vessel.

When hauling in and boarding a submerged anchor, the preferred method of using the disclosed device is as follows:

With the pins 12 in their horizontal position, the vessel's winch cable is pulled from the winch (located in the vessel's center), across the aft deck, beyond the stern and (usually with the aid of a diver or a dinghy), is attached to the anchor's marker buoy. The winch cable, extending past the stern into the water, is allowed to move to either the port or starboard side. Then, the pin on the side of the vessel opposite the winch cable is raised. For example, if the winch cable is on the port side, the starboard pin will be raised.

Then the cable will be allowed to move, or the vessel will move, so that the winch cable is bearing against the raised pin. The remaining pin is now extended to its vertical position, thereby "trapping" the cable between the two pins.

The winch is then activated, pulling the winch cable and the attached buoy toward the vessel's stern. When the buoy nears the vessel's stern, both pins are put in their horizontal position. In this position the buoy may be brought on board with ease and without entangling the buoy, cable line, and pins.

While holding the pennant line, the buoy is detached from the pennant line and moved to one side of the deck for storage. The winch cable is then attached to the pennant line and the pennant line is trapped between the two pins in the same manner as was the winch cable. The pins are maintained in their vertical position while "breaking" and hauling in the anchor.

When the anchor has been brought to the surface and is at the stern ready to be boarded, the pins are lowered to their horizontal position. The anchor may then be brought on board, the deck being free of obstructing, entangling pins and the pins being tucked away, safe from the tremendous weight and force of the anchor that is being moved about the deck.

While in accordance with the provisions of the statutes, there is illustrated and described herein specific embodiments of the invention, those skilled in the art will understand that changes may be made in the form of the invention covered by the claims, and certain features of the invention may sometimes be used to advantage without a corresponding use of the other features.

The embodiments of the invention in which an exclusive property or privilege is claimed are defined as follows:

1. An apparatus for use by marine vessels in handling anchors and the like, including bringing anchors on board said vessel, said apparatus comprising a pair of pin assemblies, each assembly comprising:

a. a pin;

b. a frame providing rotatable support for the pin at both ends of the pin;

c. a rotatable drum to which the frame is attached;

d. a means for rotating the drum;

e. a means for preventing drum rotation;

f. a cover plate attached to the frame and drum, the plate forming a part of the vessel's deck when the rotational axis of the pin is horizontally disposed; and g. a housing for the pin assembly, said housing being recessed into the deck floor of the vessel in such a way that the top of the housing forms part of the vessel's deck.

2. The device of claim 1 wherein the means for rotating the drum comprises a pneumatically operated piston and cylinder arrangement.

3. The device of claim 1 wherein a. part of the drum surface is flat and b. the means for preventing drum rotation comprises a pneumatically operated slideable wedge, said wedge in its extended position fitting under the flat surface of the drum when the rotational axis of the pin is vertically disposed, the wedge maintaining the pin in said vertical position.

4. The device of claim 1 wherein the rotational axis of the drum is horizontal and perpendicular to the rotational axis of the pin.

5. An apparatus for use by marine vessels in handling anchors and the like, including bringing anchors on board said vessel, said apparatus comprising a pair of pin assemblies, each assembly comprising:

a. a pin;

b. a frame providing rotatable support for the pin at both ends of the pin;

c. a pneumatically operated rotatable drum to which the frame is attached, part of the drum surface being flat, the axis of rotation of the drum being horizontal and perpendicular to the axis of rotation of the pin;

d. a slideable wedge, pneumatically operated, said wedge in its extended position fitting under the flat surface of the drum when the rotational axis of the pin is vertically disposed, the wedge maintaining the pin in said vertical position, e. a cover plate attached to the frame and drum, the plate forming a part of the vessel's deck when the rotational axis of the pin is horizontally disposed; and f. a housing for the pin assembly, said housing being recessed into the deck floor in such a way that the top of the housing forms part of the vessel's deck.

* * * * *